US006835051B2

(12) United States Patent
Heim et al.

(10) Patent No.: US 6,835,051 B2
(45) Date of Patent: Dec. 28, 2004

(54) MOTOR WITH IMPELLER/ROTOR COMBINATION

(75) Inventors: Markus Heim, Kirchdorf/Krems (AT); Herbert Gösweiner, Windischgarsten (AT)

(73) Assignee: TCG Unitech Aktiengesellschaft, Kirchdorf/Krems (AT)

( * ) Notice: Subject to any disclaimer, the term of this patent is extended or adjusted under 35 U.S.C. 154(b) by 0 days.

(21) Appl. No.: 10/140,948

(22) Filed: May 9, 2002

(65) Prior Publication Data

US 2002/0166520 A1 Nov. 14, 2002

(30) Foreign Application Priority Data

May 11, 2001 (AT) ..... A 759/2001

(51) Int. Cl.[7] ..... F04B 17/00
(52) U.S. Cl. ..... 417/423.7; 417/357
(58) Field of Search ..... 417/355, 356, 417/357, 423.7; 310/53

(56) References Cited

U.S. PATENT DOCUMENTS 2,782,721 A * 2/1957 White ..... 417/357
5,117,141 A * 5/1992 Hawsey et al. ..... 310/114
5,332,374 A * 7/1994 Kricker et al. ..... 417/420
5,545,017 A * 8/1996 Strohl et al. ..... 417/423.7
6,132,186 A * 10/2000 Cooper et al. ..... 417/423.7

FOREIGN PATENT DOCUMENTS

| | | |
|---|---|---|
| DE | 1613626 | 5/1970 |
| DE | 2556631 | 7/1976 |
| DE | 19617495 | 11/1997 |

* cited by examiner

*Primary Examiner*—Justine R. Yu
*Assistant Examiner*—Timothy P. Solak
(74) *Attorney, Agent, or Firm*—Dykema Gossett PLLC

(57) ABSTRACT

The invention relates to a pump for fluid media, more particularly to a cooling water pump for internal combustion engines with an electric motor configured as a disk armature for actuating the pump, said electric motor being directly connected to an impeller (6) of the pump. A simple structure and high operational reliability are achieved in that a driving flange (18) projects radially outward on the outer circumference of the pump's impeller, magnets (19) or windings (20) being molded therein for the contactless drive of the impeller (6).

7 Claims, 2 Drawing Sheets

MOTOR WITH IMPELLER/ROTOR COMBINATION

BACKGROUND OF THE INVENTION

The invention relates to a pump for fluid media, more particularly to a cooling water pump for internal combustion engines with an electric motor configured as a disk armature for actuating the pump, the electric motor being directly connected to an impeller of the pump. Depending on the purpose intended to be served, diverse requirements are placed on pumps. In electric coolant pumps for example, absolute reliability is an important criterion since, upon failure of the cooling system, important damage may be caused to the internal combustion engine. Furthermore, in an effort to reduce cost and to achieve the greatest freedom from component parts is an aim that is strived for. Further directions relate to the available mounting space, which is restricted in many cases.

DESCRIPTION OF PRIOR ART

DE 196 17 495 A is directed to a fuel pump for motor vehicles which is provided with a rotor that serves as a disk armature of an electric motor on the one side and as a pump impeller on the other side. Blades for lifting the medium are configured for this purpose on the outer circumference of the rotor. Such a pump only permits to achieve restricted efficiency as the pump geometry is not very optimal. Furthermore, with the classic disk armature, the current has to be supplied to the electric windings in the disk by way of brushes that have to be sealed from the flowing medium.

DE 16 13 626 A or DE 25 56 631 A describe electric motors which actuate pumps or fans and in which a winding is arranged in the region of the impeller. The torque of such motors is limited, though, and fail-safe cooling water pumps for motors of motor vehicles cannot be produced easily.

SUMMARY OF THE INVENTION

It is the object of the present invention to provide a pump that avoids these drawbacks, has a simple structure while having the smallest possible size, and provides fall-safe operation.

The solution to these objects in accordance with the invention is achieved in that a driving flange projects radially outwardly on the outer circumference of the pump's impeller, with magnets or windings molded therein for the contactless drive of the impeller. Such a pump has but one movable component part, which is the impeller with the driving flange molded thereto. The large diameter of the driving flange permits a great driving torque to be achieved, but the dimension of the pump in the axial direction is very small. The electric motor of the pump in axial direction is very small. The electric motor of the pump in accordance with the invention is not configured as a classic disk armature in which flat pressed magnet coils, which are supplied with current via brushes, are arranged in the disk-shaped rotor, but as a permanent magnet DC motor or as a three-phase asynchronous motor. In both cases, the torque is provided by an outer magnetic field produced in the stator. Assuming that the motor of the pump is in principle driven from DC energy, the rotating field is produced by an electronic circuit. The additional advantage thereof is that the performance of the pump can be very readily adjusted according to the specific needs.

In a particularly preferred variant of the invention, the electric motor is configured to operate in a "wet" environment. This means that the movable parts within the pump are not sealed, i.e., the gap between stator and rotor of the pump is also flooded with the medium to be delivered.

In another particularly preferred variant of the invention, the impeller is designed as an axial-radial flow impeller that is provided with a flange face to which blades are molded, the driving flange being arranged radially outside of the flange face. In this context, it is particularly preferred to have the driving flange offset in axial direction. This makes it possible to freely configure the delivery housing radially outside of the impeller and to concurrently provide a part of the stator between the delivery housing and the driving flange.

The structure of the pump of the invention is particularly simple and inexpensive if the impeller is made of plastic material and if the magnets are molded thereto by injection molding in the form of inserts. Such a solution is also characterized by a robust mechanical structure. It should be born in mind though that, to prevent demagnetisation, the magnets can only be heated within permissible limits. As an alternative, the magnets can also be magnetized in situ after the impeller is manufactured so that the injection molding process is not subject to any limitations.

BRIEF DESCRIPTION OF THE DRAWINGS

The present invention will be described more explicitly herein after with the help of exemplary embodiments illustrated in the drawings.

DETAILED DESCRIPTION OF THE PREFERRED EMBODIMENTS

Figure 1:
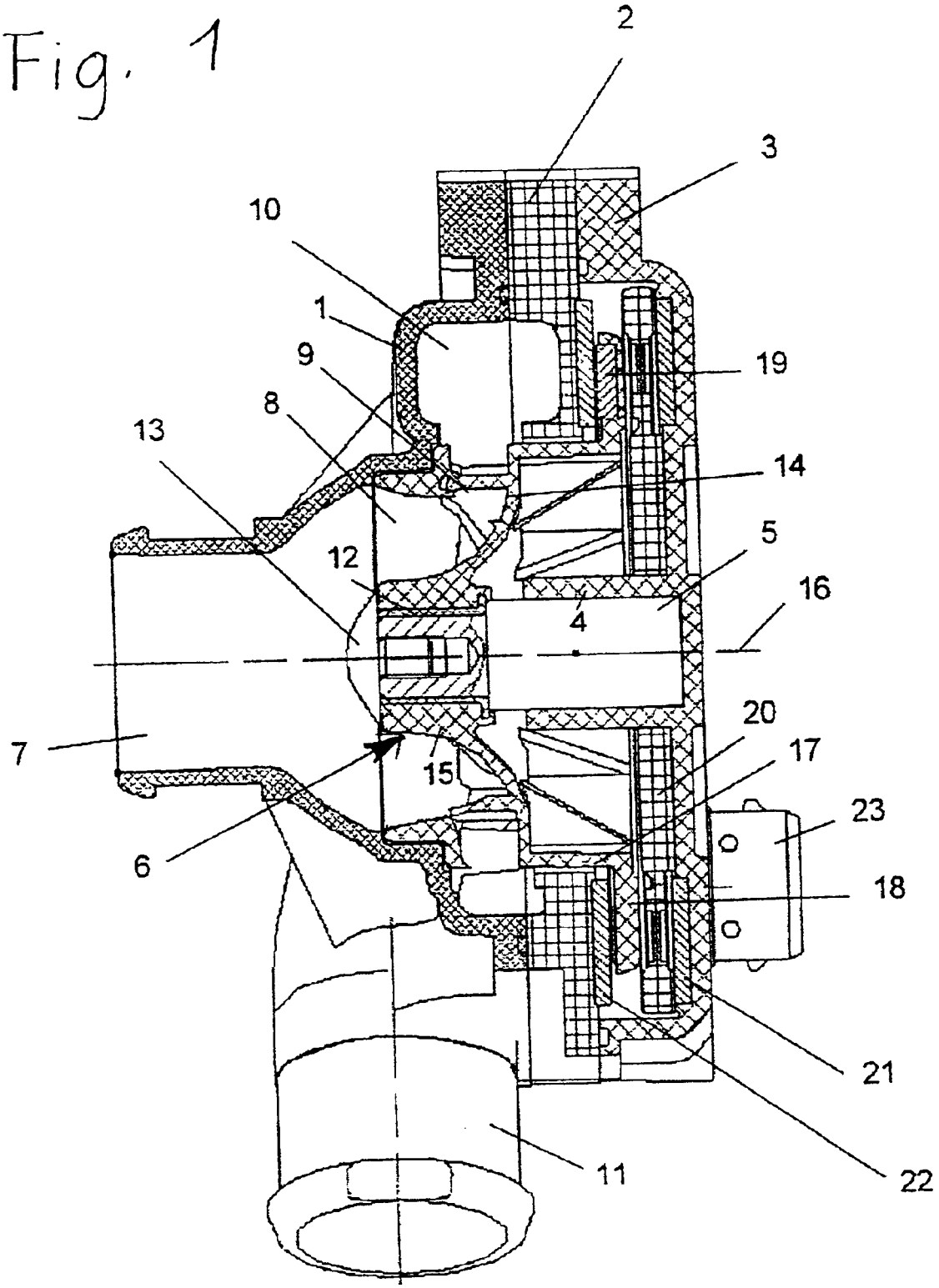
FIG. 1 is a sectional view of a first variant of the invention.

The housing of the pump of the invention as illustrated in FIG. 1, which is an electric coolant pump for an internal combustion engine lifting a customary coolant composed of water and glycol, is comprised of a hydraulic lid 1 that encompasses the admission manifold 7 and half of the delivery manifold 10, of a hydraulic bottom 2 that encompasses the second half of the delivery manifold 10 and carries one half of the stator, and of a motor lid 3 that closes the housing on the side opposite the hydraulic lid 1. In the axial region the motor lid 3 carries an axle 5 that supports the impeller 5. The axle 5 is retained by a collar 4 of the motor lid 3 and is injection molded as an insert during the manufacturing of the motor lid 3. The impeller 6 is configured as an axial-radial flow impeller, i.e., the medium to be delivered flows in axial direction from the admission manifold 7 formed by the hydraulic lid. Blades 9 are arranged in the flow channels 8 of impeller 6, the direction of flow of the medium in the channels being deviated radially outwardly so that the medium is delivered to the delivery manifold 10. The medium is evacuated via a delivery tube 11 that emerges in a screw-like fashion from the hydraulic lid 1.

A plain bearing bush 12, which can be extrusion-coated in the manufacturing process, is molded to the hub 15 of impeller 6. Alternatively, impeller 6 can be manufactured by two-component injection molding. A screw 13 secures impeller 6 to the axle 5.

The rear side of the flow channels 8 of impeller 6 is formed by a disk 14 that is curved inward in direction of the hub 15 and is, on the outside, located on an axis which is perpendicular to the axis 16 of impeller 6. A tubular portion 17 is formed on the outer circumference of the disk 14, the tubular portion carrying on its other end a driving flange 18 extending outwardly.

Magnets 19 are molded as inserts to the driving flange 18, the magnets constituting the rotor of the electric motor. The magnets 19 are rare earth magnets based on Nd—Fe—B or Pr—Fe—B respectively, and have an extremely high field intensity. Plastic compounds i.e., so-called polymer magnets, can also be used, these magnets being made by pressing a mixture of magnetic particles and of a bonding agent based on epoxy resins or by injection molding a compound. High magnetic properties can be achieved at low cost in this way. The windings 20 of the stator, which substantially forms a disk parallel to the driving flange 18, are fastened to the collar 4 of motor lid 3 or to the motor lid 3 itself. A magnetic circuit disk 21 is provided on the side of the winding 20 which is opposite the driving flange 18. The magnetic circuit is closed by another magnetic circuit disk 22 fastened to the hydraulic bottom 2. To reduce gap leakage and to increase power density, the second magnetic circuit disk can also be molded to the impeller. The magnetic circuit disks can be made in a conventional manner of sheets of metal or of plastic rings with steel particles molded therein.

The winding 20 of the stator itself is an air-core winding so that the dimensions can be very compact. The motor of the pump of the invention is supplied with current by way of a plug 23, the electronics for the electronic commutation, which is not illustrated in the drawing herein, can thereby be accommodated in the region of the pump or outside thereof. Alternatively, the electronics of the motor can be cast together with the winding 20 for example.

Figure 2:
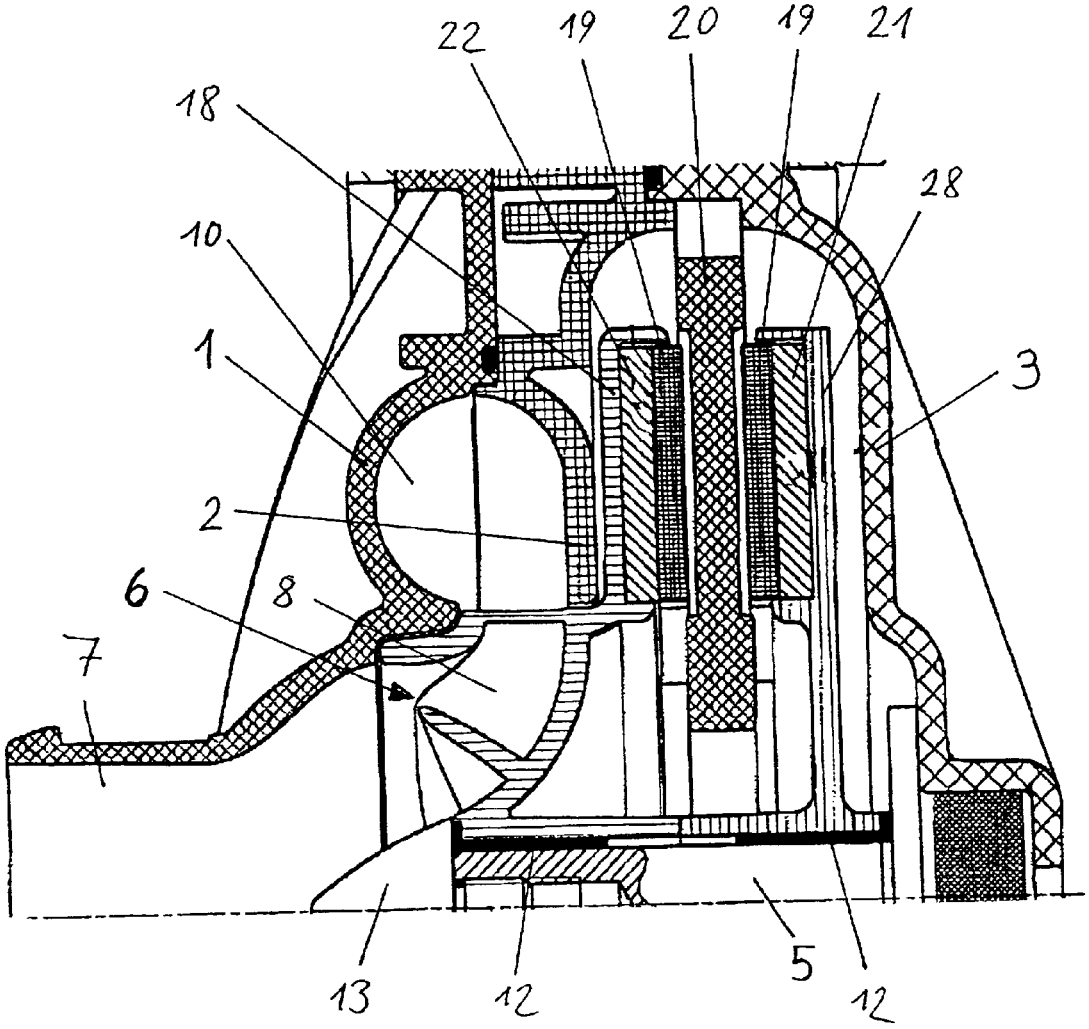
FIG. 2 is a partial sectional view of another variant of the invention.

The variant of FIG. 2 differs from that of FIG. 1 in that, in addition to the driving flange 18 projecting outward from impeller 6, there is provided another driving flange 28 which is arranged behind the stator 20 and is substantially symmetrical to the first driving flange 18.

The torque can thus be substantially increased and the symmetrical configuration permits to largely avoid axial bearing forces. The longer configuration in axial direction permits to place two bearing bushes 12 one behind the other, both also providing a support in axial direction. This variant also differs from the variant described herein above in that the magnetic circuit disks 21 and 22 are arranged on the driving flanges 28 and 18 respectively or are the driving flanges themselves, which is advantageous for the efficiency of the motor.

The screw 13 is configured as a spinner, which allows for convenient flow. To increase hydraulic efficiency, guide blades, which are not illustrated in the drawing herein, may be provided in the admission housing 7.

It is obvious that, if higher requirements are placed on performance and torque, it is possible to provide further rotor disks which are arranged one behind the other in axial direction.

Like a conventional coolant pump, the cooling water pump of the invention can be mounted to the internal combustion engine as a plug-in module. As compared to mechanically actuated pumps, the advantage thereof is that it can be mounted independent of belt drives or the like on the one side and that the control of the pump can be made more sensitive to the respective need for cooling of the internal combustion engine. As the pump is designed to operate in a "wet" environment i.e., as the entire interior space is flooded with the coolant or with the medium to be delivered, no glands, rotating mechanical seals, shaft seals or the like are needed, which lowers the costs and improves operational reliability.

What is claimed is:

1. A pump for fluid media comprising a housing defining an admission manifold and a delivery manifold; an impeller rotatably mounted within the housing to move fluid media from said admission manifold to said delivery manifold; a stator mounted within the housing, an electric motor configured as a disk armature directly connected to said impeller, and wherein first and second driving flanges project radially outwardly on the outer circumference of said impeller and symmetrically arranged on opposite sides of said stator, magnets or windings being molded in said first and second driving flanges for the contactless drive of the impeller, said fluid media flowing through said housing to wet said stator.

2. The pump according to claim 1, wherein the electric motor is electronically commutated.

3. The pump according to claim 1, wherein the impeller is designed as an axial-radial flow impeller that is provided, on the side opposite the admission side, with a flange face to which blades are molded and wherein the first and second driving flanges are arranged radially outside of said flange face.

4. The pump according to claim 3, wherein the first and second driving flanges are offset in axial direction.

5. The pump according to claim 1, wherein the impeller is made of plastic material and wherein the magnets are molded thereto by injection molding in the form of inserts.

6. The pump according to claim 1, wherein the impeller is made of plastic material and wherein the magnets are configured as plastic compound magnets.

7. The pump according to claim 1, containing a single stator.

* * * * *